US007011552B2

(12) United States Patent
Hoxha

(10) Patent No.: US 7,011,552 B2
(45) Date of Patent: Mar. 14, 2006

(54) HOUSINGS WITH WALL MOUNTED CONNECTOR MEMBERS, CONNECTOR MEMBERS AND METHODS OF FORMING THE SAME

(75) Inventor: Vladimir Hoxha, Ontario (CA)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/855,302

(22) Filed: May 27, 2004

(65) Prior Publication Data

US 2005/0266716 A1 Dec. 1, 2005

(51) Int. Cl.
*H01R 13/415* (2006.01)

(52) U.S. Cl. ..... 439/741

(58) Field of Classification Search ..... 439/741, 439/870, 84; 29/844, 882
See application file for complete search history.

(56) References Cited

U.S. PATENT DOCUMENTS 2,533,987 A * 12/1950 Bahr ..... 439/741
2,673,336 A * 3/1954 Peters ..... 439/870
3,504,107 A * 3/1970 Wagner et al. ..... 174/153 R
3,541,496 A * 11/1970 Castellani ..... 439/870
5,065,283 A * 11/1991 Adachi et al. ..... 361/775

* cited by examiner

*Primary Examiner*—Neil Abrams
(74) *Attorney, Agent, or Firm*—Myers Bigel Sibley & Sajovac

(57) ABSTRACT

An electrical circuit assembly includes a housing. A connector member is attached to and extends through an opening in a wall of the housing. The connector member has a contact member on an end thereof outside the housing and a longitudinally extending bore therein extending towards and having an opening into the housing. The wall may have substantially no cracks therein in a region proximate the opening. A pin is provided having a first end positioned within the bore and a second end extending from the opening of the bore. A portion of the connector member around the first end of the pin is collapsed to contact and retain the pin within the bore and to contact an inner surface of the wall to retain the connector member within the wall. Methods and connector members are also provided.

29 Claims, 9 Drawing Sheets

HOUSINGS WITH WALL MOUNTED CONNECTOR MEMBERS, CONNECTOR MEMBERS AND METHODS OF FORMING THE SAME

BACKGROUND OF THE INVENTION

The present invention relates to housings and, more particularly, to housings having connector members.

A variety of different applications use housings with connector members passing through a wall of the housing to connect a component within the housing to a component outside the housing. For example, an electrical circuit within the housing may be connected to an external circuit. The housing may be provided for environmental protection, physical isolation or the like. One example of use of such a housing is a photocontrol device.

Photocontrol devices may be used in a variety of applications where it is desirable to provide a control signal responsive to detection of a light level. One common application of such photocontrol devices is in the detection of ambient light levels. In particular, photocontrol devices may be used to detect the transition from daylight to night so that lights may be turned on for security, safety and/or aesthetic reasons. For example, street lights are generally provided with photocontrol devices to turn on the street lights at dusk. An example of such a photocontrol device is the Model 2000 series of photocontrols available from Tyco Electronics Corporation. Such a device may be a switch mode power converter of relatively high voltage alternating current to relatively low voltage direct current. The light may be detected by a photocontrol transistor and the electric impulses therefrom may be analyzed by various circuit components having a programmable reference level. The transistor may further operate as a switch (ON/OFF), based on a pre set value corresponding to the intensity of detected light passing from day to night and vice versa.

In such photocontrol devices, it is known to provide an electrical connector extending from the housing, typically an alternating current (AC) power connector, the configuration of which may vary based on the application/geographic location. Internally, the pins of the AC power connector are electrically coupled to a photosensor switching circuit within the photocontrol device. A variety of methods are known for attaching the AC power connector pins in the housing of the photocontrol device and coupling them electrically to the circuit within the housing. One approach uses a screw thread on a connector pin and attaching nut to secure the connector pin to the base of the housing. The secured connector pin may then be electrically connected to the internal circuit, for example, by a contact wire. Such an approach generally requires additional parts and assembly steps in assembling the photocontrol device.

In another approach, a conventional riveting method is used to attach the external connector pin to a base of the housing. In other words, an end of the connector pin extending into the housing is bent outward and flattened (flanged) to contact the wall of the housing. Internally, the rivet flange may press against a contact pad of a connector plate positioned on the wall of the housing. The connector plate, in turn, may extend into the housing and be attached to the circuit within the housing. In such an arrangement, the rivet is generally used both for the mechanical connection and to provide an electrical contact between the external connector pin and the contact pad and, as such, the electrical connection may be sensitive to the quality of the rivet.

SUMMARY OF THE INVENTION

Embodiments of the present invention provide methods for attaching a pin to a housing. An opening is formed in a wall of the housing. The opening has an inner diameter corresponding to an outer diameter of a connector member. The connector member is positioned extending through the opening. The connector member has an outer diameter thereof in a region within the wall corresponding to the inner diameter of the opening, a contact member on an end thereof outside the housing, and a longitudinally extending bore therein extending towards and opening into the housing. The pin is positioned with a first end of the pin within the bore and a second end of the pin extending from the bore. The connector member is longitudinally compressed a selected distance towards the wall to secure the pin within the bore and to secure the connector member within the wall. Longitudinally compressing the connector member may include longitudinally compressing the connector member without cracking the wall and the selected distance and a depth of the bore may be selected to prevent cracking of the wall.

In some embodiments of the present invention, the second end of the pin is electrically coupled to an electrical circuit within the housing. For example, the second end of the pin may be soldered directly to the electrical circuit. The wall may be a base member of the housing and wherein the method may further include, following electrically coupling the second end of the pin, positioning a cover over the base member to provide the housing enclosing the electrical circuit. The electrical circuit may be coupled to a circuit external to the housing by electrically coupling the contact member to the circuit external to the housing. The contact member may be, for example, an alternating current (AC) power connector and coupling the contact member to the circuit external to the housing may include inserting the contact member into an AC power receptacle. The electrical circuit within the housing may be a photocontrol sensor circuit.

In further embodiments of the present invention, longitudinally compressing the connector member includes forming a bell shaped rivet around the pin from a portion of the connector member including the bore. Forming an opening in the wall may include forming three openings and positioning a connector member in each opening and positioning a pin in a bore of each connector member and longitudinally compressing each connector member to secure the pins within the bores and to secure the connector members within the wall.

In other embodiments of the present invention, the bore ends at a point intermediate an inner and an outer surface of the wall when the connector member is positioned in the housing. The wall may have a thickness between its inner and outer surfaces of about 1.75 millimeters (mm) and the bore may end at a point of from about 0.2 mm from the inner surface to about 0.5 mm from the inner surface. The outer diameter of the connector member may be about 3.15 mm to about 3.25 mm and the inner diameter of the opening in the wall may be about 3.30 mm to about 3.40 mm and the bore may have a diameter of about 2.5 mm and the pin may have an outer diameter of about 2.25 mm.

In further embodiments of the present invention the housing includes a first and second housing part and the first housing part includes the wall. A flexible electrical circuit is positioned adjacent the wall in a first orientation. The flexible electrical circuit is electrically coupled directly to the second end of the pin. The flexible electrical circuit is rotated to a second orientation having a portion thereof extending substantially orthogonally from the wall. The second housing part is attached to the wall to enclose the flexible electrical circuit therein in the second orientation. The flexible circuit may be a photocontrol sensor circuit and the contact member may be an alternating current (AC) power connector and coupling the contact member to the circuit external to the housing may include inserting the contact member into an AC power receptacle.

In other embodiments of the present invention, an electrical circuit assembly includes a housing having an opening in a wall thereof. A connector member is attached to and extends through the opening in the wall of the housing. The connector member has a contact member on an end thereof outside the housing and a longitudinally extending bore therein extending towards and having an opening into the housing. The wall has substantially no cracks therein in a region proximate the opening. A pin has a first end positioned within the bore and a second end extending from the opening of the bore. A portion of the connector member around the first end of the pin is collapsed to contact and retain the pin within the bore and to contact an inner surface of the wall to retain the connector member within the wall. The collapsed portion of the connector member around the first end of the pin may be substantially bell shaped.

In further embodiments of the present invention, a flexible electrical circuit in the housing has a portion thereof extending longitudinally within the housing substantially orthogonally to a portion thereof coupled to the second end of the pin. A second and a third connector member may extend through second and third openings in the wall of the housing and have contact members thereon and a second and third pin respectively extending from openings of bores in the second and third connector members. The second and third connector members may be collapsed to contact and retain their respective pins within their respective bores and to retain the connector members within the wall. The contact members may be an alternating current (AC) power connector. The bore may end at a point intermediate an inner and an outer surface of the wall when the connector member is positioned in the housing.

In some embodiments of the present invention, the depth of the bore determines the point were the upset (i.e., collapsing or bell shape forming) starts. This depth in such embodiments is slightly further than the inside surface of the base or other wall where attachment is occurring. The shoulder of the collapsed pin in such embodiments is directly at the inside of the base (or other mounting wall) surface, which may provide a good fix with the base without causing cracks. If the bore depth is increased too much, the fixing operation may crack the base. If it is decreased, the quality of the fix might be degraded and the pin may not be rigid and secure in the base.

In other embodiments of the present invention, connector members for attaching in a wall of a housing include a contact member on an end thereof to be positioned outside the housing. A longitudinally extending bore therein extends towards and has an opening at an end of the connector member opposite the contact member. The bore is configured to receive a pin therein and a length of the bore from the opening and a wall thickness of the connector member around the bore are selected to allow collapsing of the connector member into a substantially bell shape around a pin positioned in the bore to retain the pin in the bore and to retain the connector member in the housing. The length of the bore and the wall thickness of the connector member around the bore may be selected to allow collapsing of the connector member without cracking of the housing proximate the connector member.

DETAILED DESCRIPTION

Figure 1A:
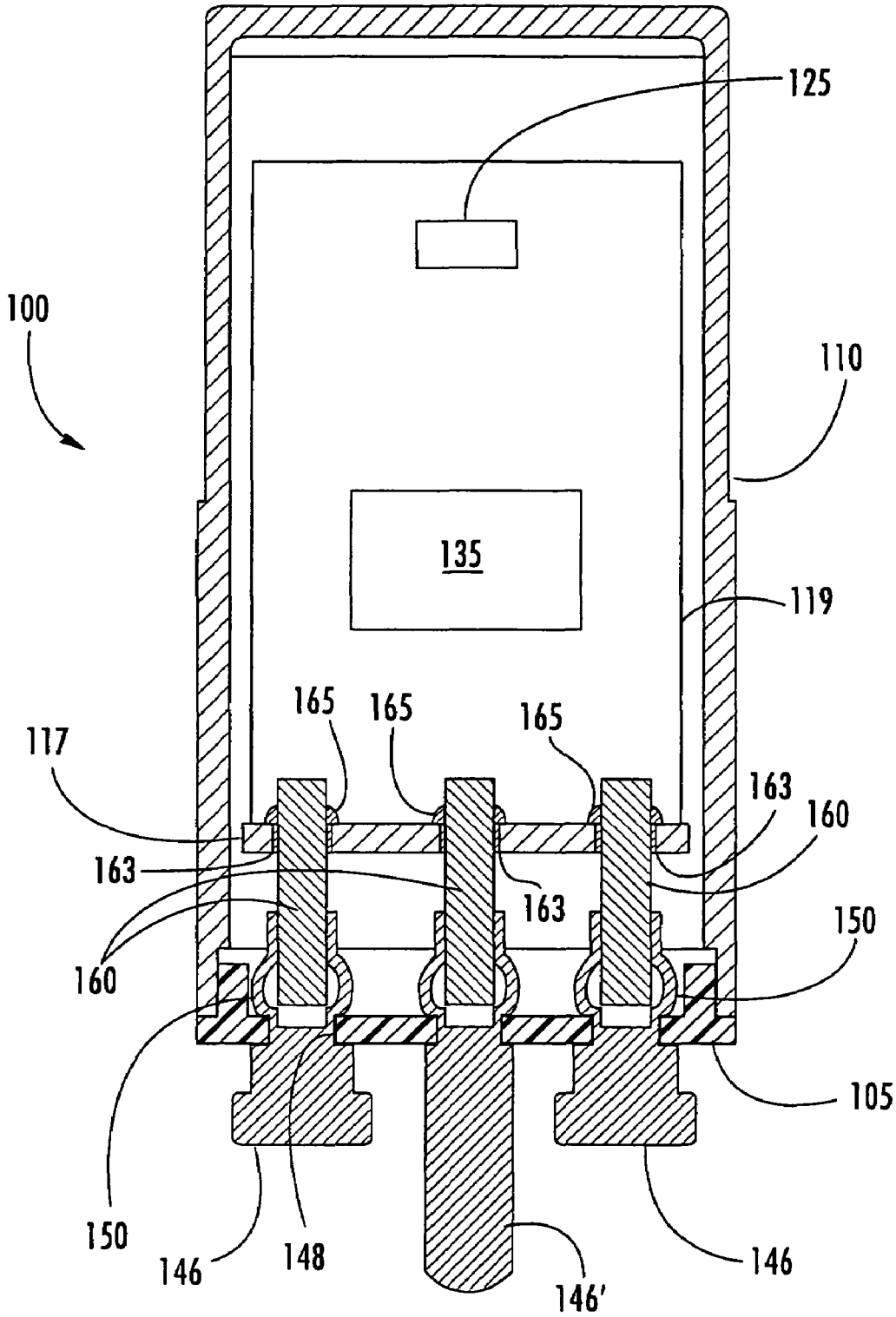
FIG. 1A is a cross sectional view of an electronics circuit assembly with wall mounted connector members according to some embodiments of the present invention.

The present invention now will be described more fully hereinafter with reference to the accompanying drawings, in which illustrative embodiments of the invention are shown. In the drawings, the relative sizes of regions or features may be exaggerated for clarity. In the drawings, when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Like reference numerals refer to like elements throughout. This invention may be embodied in many different forms and should not be construed as limited to the embodiments set forth herein; rather, these embodiments are provided so that this disclosure will be thorough and complete, and will fully convey the scope of the invention to those skilled in the art.

Figure 1B:
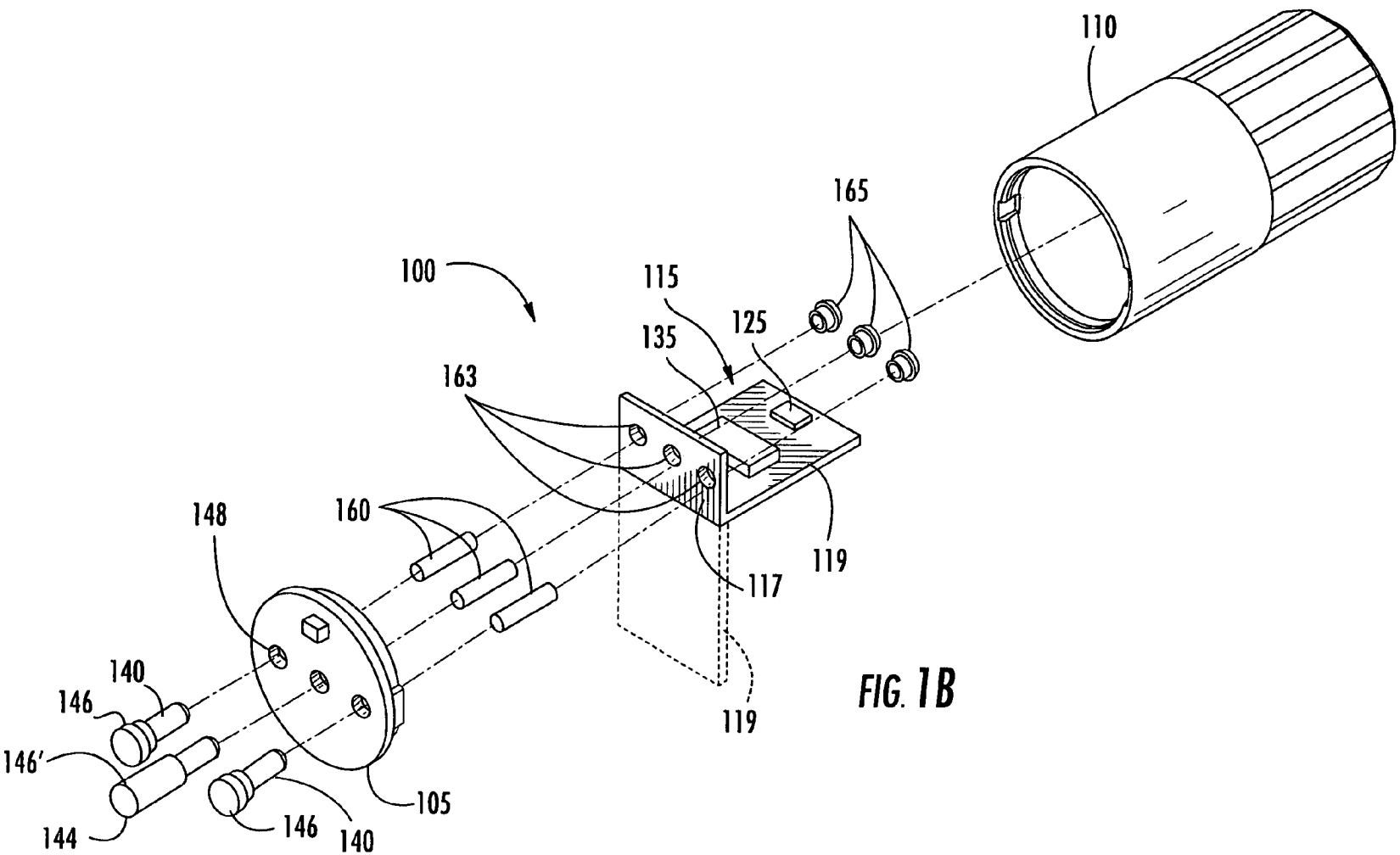
FIG. 1B is an exploded perspective view of the assembly of FIG. 1A.

Embodiments of the present invention will now be described with reference to the various embodiments illustrated in FIGS. 1A–1B, 2A–2C, 3 and 4. FIG. 1A is cross-sectional view of an electrical circuit assembly 100 according to some embodiments of the present invention. FIG. 1B is an exploded perspective view of the assembly 100 of FIG. 1A. As shown in the embodiments of FIGS. 1A and 1B, the electrical circuit assembly 100 includes a base 105 and a mating cover 110 that together define a multipart housing 105, 110 enclosing an electrical circuit 115. In some embodiments of the present invention, the base 105 may be a high temperature polyester (PBT) and the cover 110 may be an ultraviolet (UV) resistant polypropylene.

Connector members 140, 142, 144 extend through openings 148 in the base 105 of the assembly 100. The connector members 140, 142, 144 include contact members 146, 146' on an end thereof extending from the assembly 100 to make contact with an external circuit, such as an alternating current (AC) power source. As shown in the embodiments of FIGS. 1A and 1B, a neutral contact member 146' may have a different configuration than the remaining contact members 146. The illustrated contact members 146, 146' of FIGS. 1A and 1B conform to an electrical receptacle configuration used in, for example, Australia. However, other configurations of contact members may also be used in other embodiments of the present invention, including other configurations of power connectors.

In some embodiments of the present invention, the electrical circuit 115, is a photocontrol sensor circuit and the assembly is a photocontrol sensor switch device. In particular embodiments, the electrical circuit 115 may be a flexible electrical circuit that may be mounted in the assembly 100 in a bent orientation, as illustrated in FIG. 1A. As also shown in FIG. 1A, a first portion 117 of the electrical circuit 115 may be directly electrically coupled to the pins, for example, by soldering thereto. A second portion 119 of the electrical circuit 115 extends from the first portion 117. For some embodiments using a flexible electrical circuit 115, the circuit may have a first orientation with the first and second parts 117, 119 in alignment and a second orientation, as shown in FIG. 1A, wherein the second portion 119 extends at an angle from the first portion 117 in a direction substantially orthogonal to the base 105 to fit under the cover 110 when the cover 110 is attached to the base 105 to form the housing of the assembly 100.

The electrical circuit 115 may also include a photosensor 125 and a switching device 135, such as a relay, in embodiments of the present invention where the assembly 100 is a photocontrol device. In such a photocontrol device, the electrical circuit 115 may be configured so that the detection of light by the photosensor 125 activates or deactivates the relay 135. The relay 135 may, in turn, be coupled through the pins 160 and connector members 140, 142, 144 to an associated light source, such as a street lamp, that may be turned on or off responsive to the state of the relay 135.

Attachment of the pins 160 to the electrical circuit 115 is also shown in FIG. 1B for various embodiments of the present invention. The pins 160 pass through receiving openings 163 in the first portion 117 of the electrical circuit 115. The pins 160 may be electrically connected directly to the electrical circuit 115 by solder 165.

It will be understood by those of skill in the art that various conventional detection elements may be used to couple the photosensor 125 to the relay 135. For example, a comparator may be provided as a detection element in the detection circuit. The comparator may be an analog comparator having a reference voltage and/or may be a digital circuit having a programmable reference level.

Figure 2A:
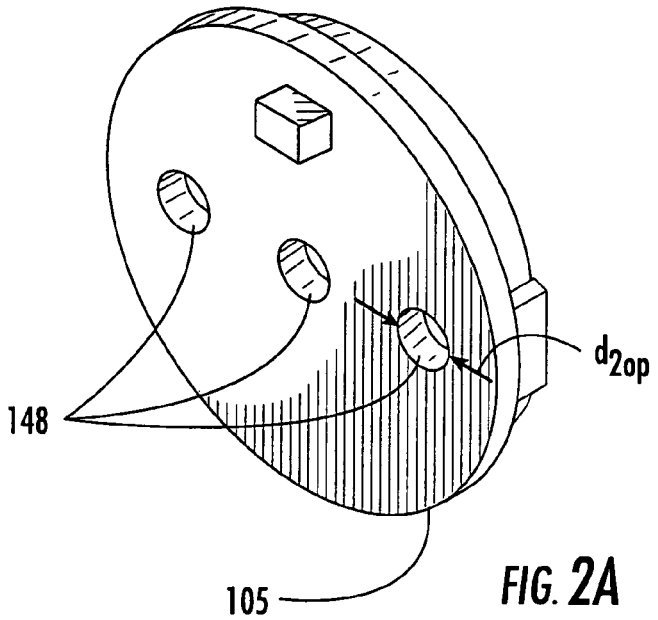
FIG. 2A is a perspective view illustrating a base member of the housing of FIG. 1 without the connector members.

FIG. 2A illustrates a base member 105 without the connector members 140, 142, 144. The base member 105 for the embodiments of FIG. 2A includes three openings 148 configured to receive respective connector members 140, 142, 144. As shown in FIG. 2A, each opening has an inner diameter $d_{2op}$. The inner diameter $d_{2op}$ may be configured to have a press fit and/or a clearance fit for the connector members 140, 142, 144. In particular embodiments of the present invention, the inner diameter $d_{2op}$ is about 3.35 millimeters (mm).

Figure 2B:
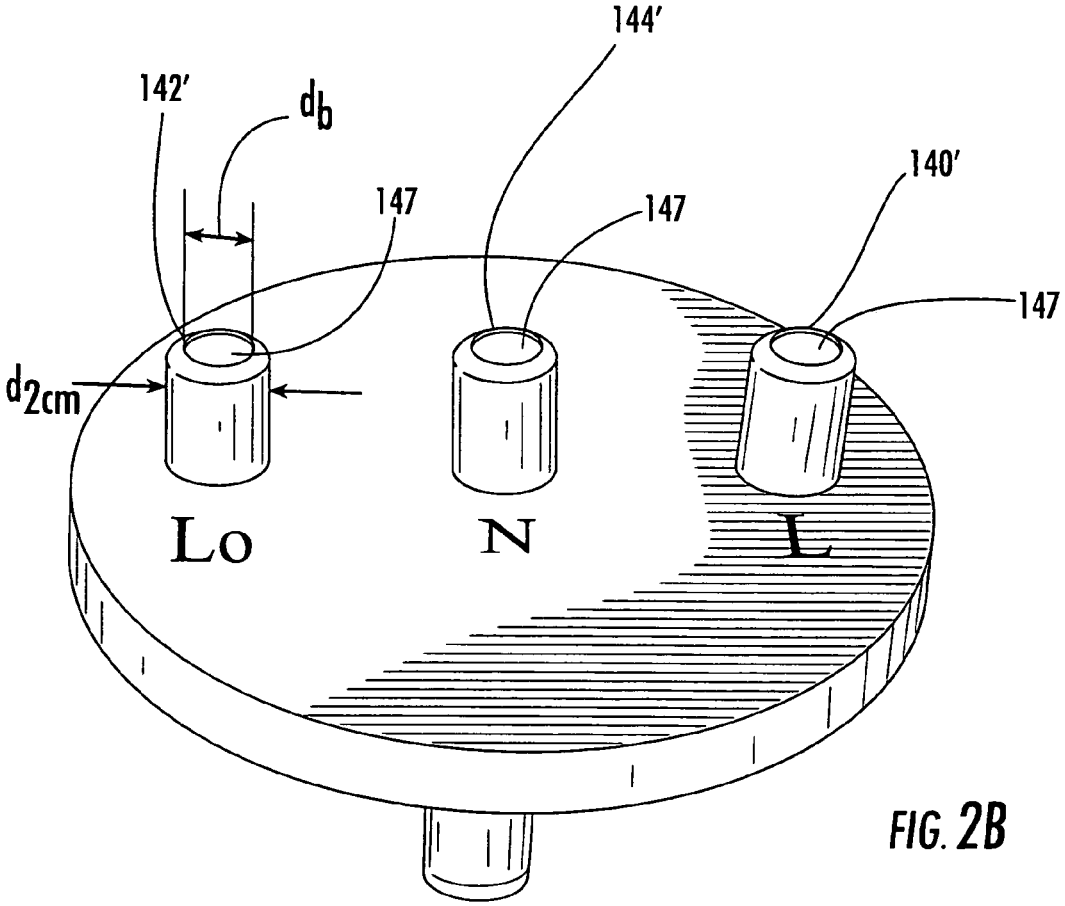
FIG. 2B is a perspective view illustrating the base member of the housing of FIG. 1 with the connector members as viewed from inside the housing.
Figure 3:
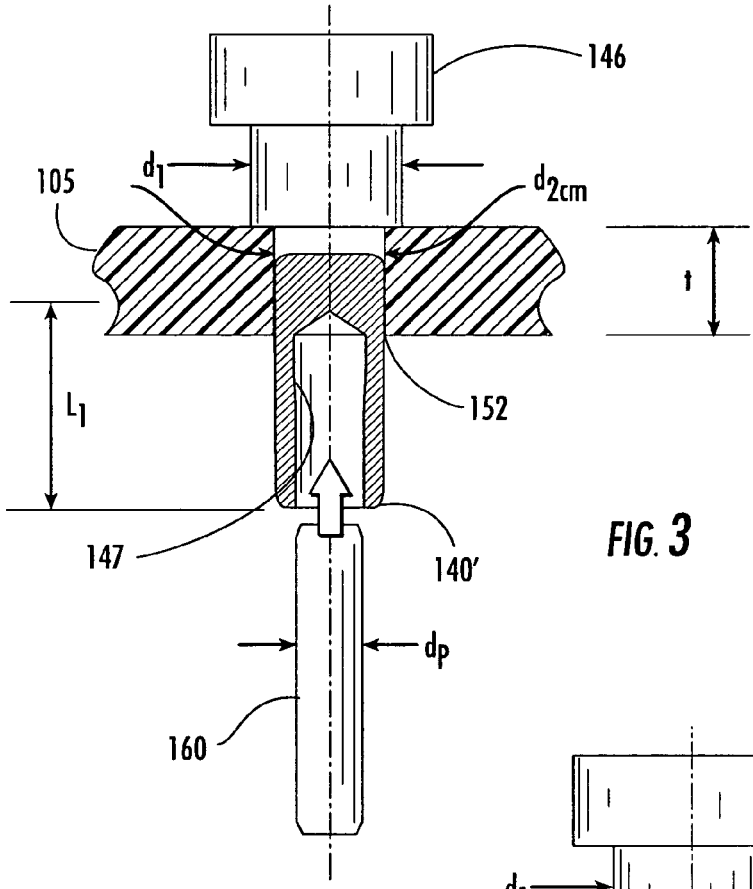
FIG. 3 is a cross-sectional side view illustrating a portion of a base member of a housing with un-compressed connector members according to some embodiments of the present invention.

FIG. 2B illustrates the base member 105 of FIG. 2A with connector members 140, 142, 144 inserted therein, as seen from within the assembly 100, before attachment of the pins 160, in other words, showing a second end 140', 142', 144' of the connector members 140, 142, 144 opposite from the end including the contact members 146, 146' (FIG. 1B). The second end 140', 142', 144' includes a longitudinally extending bore 147 therein that extends towards and opens into the housing (defined by the base 105 and the cover 110) of the assembly 100 when the base 105 is coupled to the cover 110. As shown in FIG. 2B and FIG. 3, an outer diameter $d_{2cm}$ of the second end 140', 142', 144', at least in a region within the base 105, corresponds to the inner diameter $d_{2op}$ of the openings 148. The correspondence between the diameters may be, for example, a press or slip fit. In some embodiments of the present invention, the outer diameter $d_2$ cm of the connector member is about 3.2 mm and the inner diameter $d_{2op}$ of the opening in the wall is about 3.35 mm. In such embodiments, the bore 147 may have a diameter $d_b$ of about 2.5 mm and the pin 160 may have an outer diameter $d_p$ (FIGS. 3, 4) of about 2.25 mm. The connector members 140, 142, 144 may have a different diameter $d_1$ (FIGS. 3, 4) on an end thereof including the contact member 146, 146'.

Figure 2C:
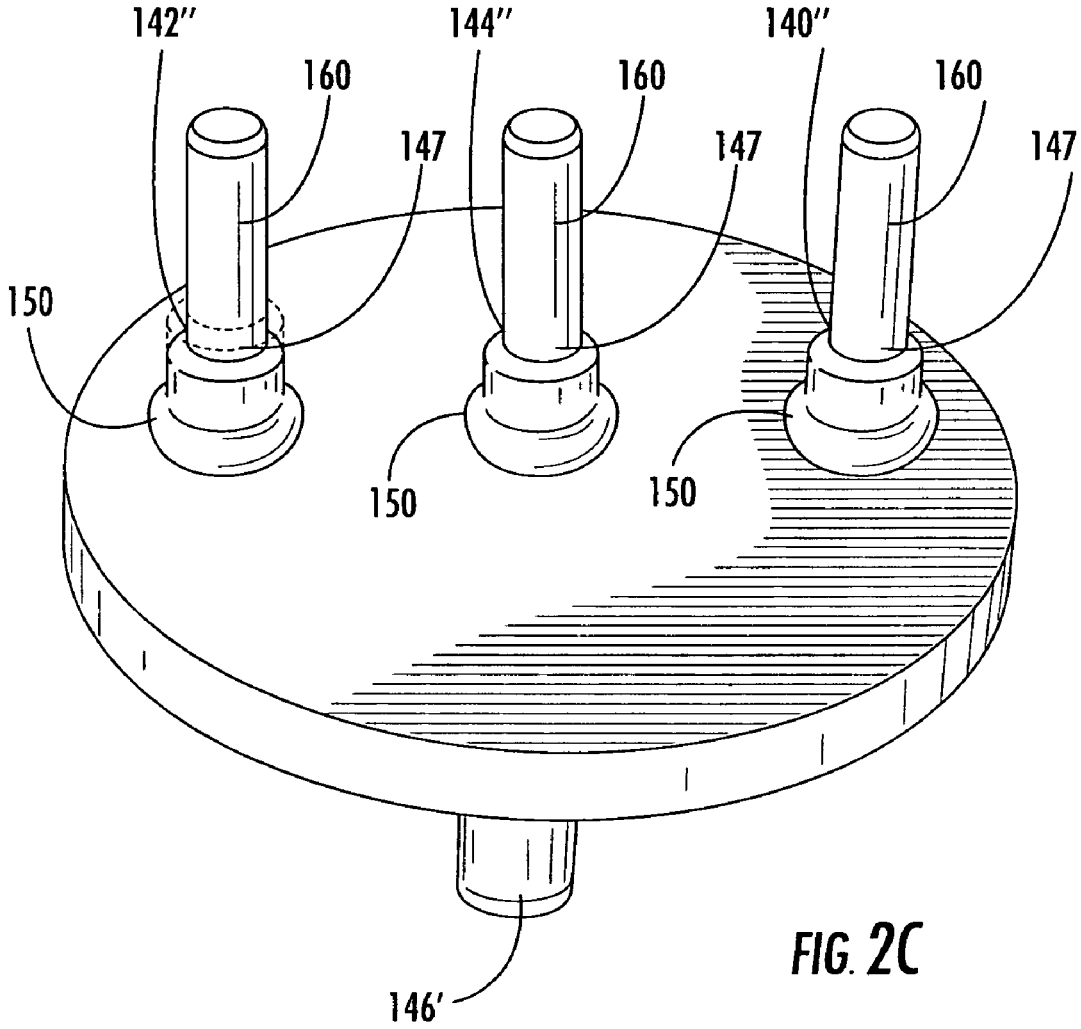
FIG. 2C is a perspective view illustrating the base member of the housing of FIG. 1 with the connector members having pins secured therein.
Figure 4:
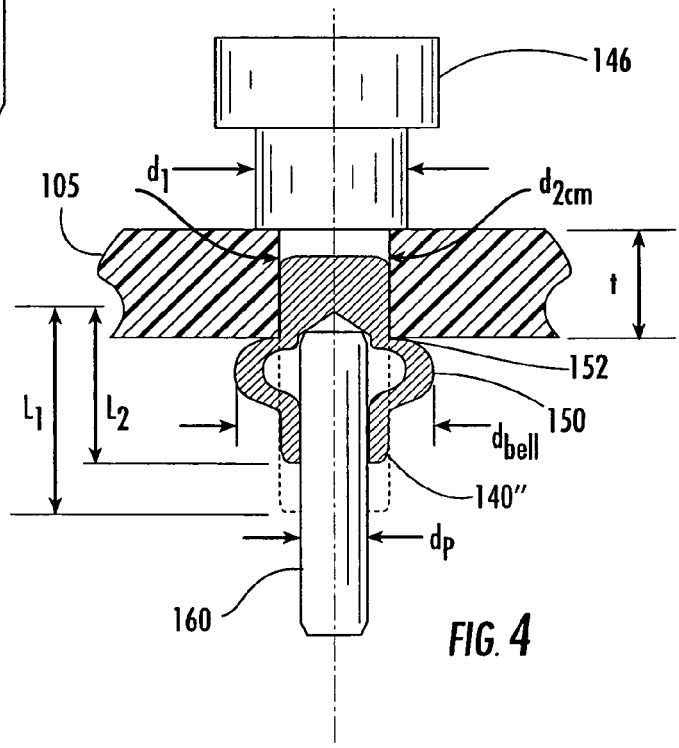
FIG. 4 is a cross-sectional side view illustrating a portion of the base member of FIG. 3 with the connector members with pins retained in the base member.

FIGS. 2C and 4 illustrate the base 105 and the connector members 140, 142, 144 of FIGS. 2B and 3 with the second end of the connector members 140", 142", 144" longitudinally compressed towards the base 105 to secure the pins 160 within the bores 147 and to secure the connector members 140, 142, 144 to the base 105. As best illustrated in FIG. 4, the second end of the connector members 140", 142", 144" may be compressed a distance ($L_1$–$L_2$) selected to prevent or reduce the risk of cracking the base 105 adjacent the openings 148. The initial depth $L_1$ of the bore 147 may be selected, in combination with the wall thickness of the bore (i.e., as defined by a difference between the diameter of the connector member $d_{2cm}$ (for embodiments with a uniform diameter of the connector member within the base 105 and around the bore 147) and the diameter $d_b$ of the bore 147) and the compression distance ($L_2$–$L_1$) to provide a desired retention strength without cracking of the base 105 during attachment.

In some embodiments of the present invention, this compression may form bell shaped rivets 150 around the pins 160, thus both retaining the pins 160 and defining a shoulder 152 abutting the base 105 to retain the connector members 140, 142, 144. The bell shaped rivets 150 may have a maximum diameter $d_{bell}$ (FIG. 4).

Figure 5:
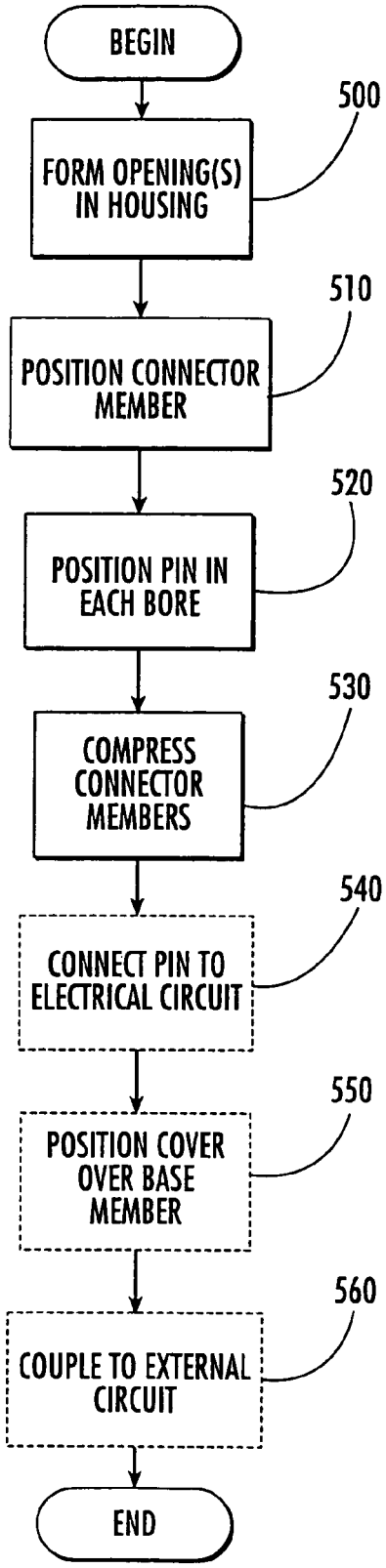
FIG. 5 is a flowchart illustrating operations for attaching a pin to a housing according to some embodiments of the present invention.

Operations for attaching a pin to a housing according to various embodiments of the present invention will now be described with reference to the flowchart illustration of FIG. 5. As shown in FIG. 5, operations begin at Block 500 with forming an opening (or openings) in a wall, such as a base of the housing. The opening may have an inner diameter corresponding to an outer diameter of a connector member to be inserted therein. The connector member is positioned extending through the opening (Block 510). The connector member may have an outer diameter in a region within the wall of the housing corresponding to the inner diameter of the opening. The connector member may further include a contact member on an end thereof outside the housing and a longitudinally extending bore therein extending towards an opening into the housing. The pin to be attached to the housing is attached with a first end of the pin within the bore of the connector member and a second end of the pin extending from the bore (Block 520). The connector member is then longitudinally compressed a selected distance towards the wall to secure the pin within the bore and to secure the connector member within the wall, without cracking the wall (Block 530). The selected distance and a depth of the bore within the connector member may be selected to prevent cracking of the wall.

In some embodiments of the present invention, operations further include electrically coupling the second end of the pin to an electrical circuit within the housing (Block 540). For example, the second end of the pin may be soldered directly to an electrical circuit positioned within the housing. The wall may be a base member of the housing and the method may further include, following electrically coupling the second end of the pin, positioning a cover over the base member to provide the housing enclosing the electrical circuit (Block 550). The electrical circuit within the housing may then be coupled to a circuit external to the housing by electrically coupling the contact member to the circuit external to the housing (Block 560). For example, the contact member may be an alternating current (AC) power connector and the contact member may be inserted into an AC power receptacle.

As will be understood from the description of the assembly with reference to FIGS. 1–4 above, the electrical circuit within the housing may be a photocontrol sensor circuit and operations at Block 500 may include forming three openings in the wall, for example, by moulding, and then positioning connector members in each at Block 510, followed by positioning a pin in a bore of each connector member at Block 520 and longitudinally compressing each connector member at Block 530 to secure all the pins within the bores and to secure all the connector members within the wall. Compressing operations at Block 530 may include compressing the connector member to form a bell shaped rivet around the pin from a portion of the connector member including the bore therein. A depth of the bore may be selected such that the bore ends at a point between the inner and outer surfaces of the wall when a connector member is positioned in the housing.

Referring now to the flow chart illustration of FIG. 6, further operations related to forming a housing including an electrical circuit therein will be described. Operations begin at Block 600 by positioning a flexible electrical circuit adjacent the wall in a first orientation, for example, in an unfolded orientation. The flexible electrical circuit can be directly electrically coupled to the second end of the pin (Block 610). The flexible electrical circuit may then be rotated to a second orientation having a portion thereof extending substantially orthogonally away from the wall (Block 620). An additional part of the housing, such as a cover, is then attached to the wall to enclose the flexible electrical circuit therein in the second orientation (Block 630). Thus, the second orientation may be selected to fit properly within the housing defined by the wall and the cover of the housing.

Figure 6:
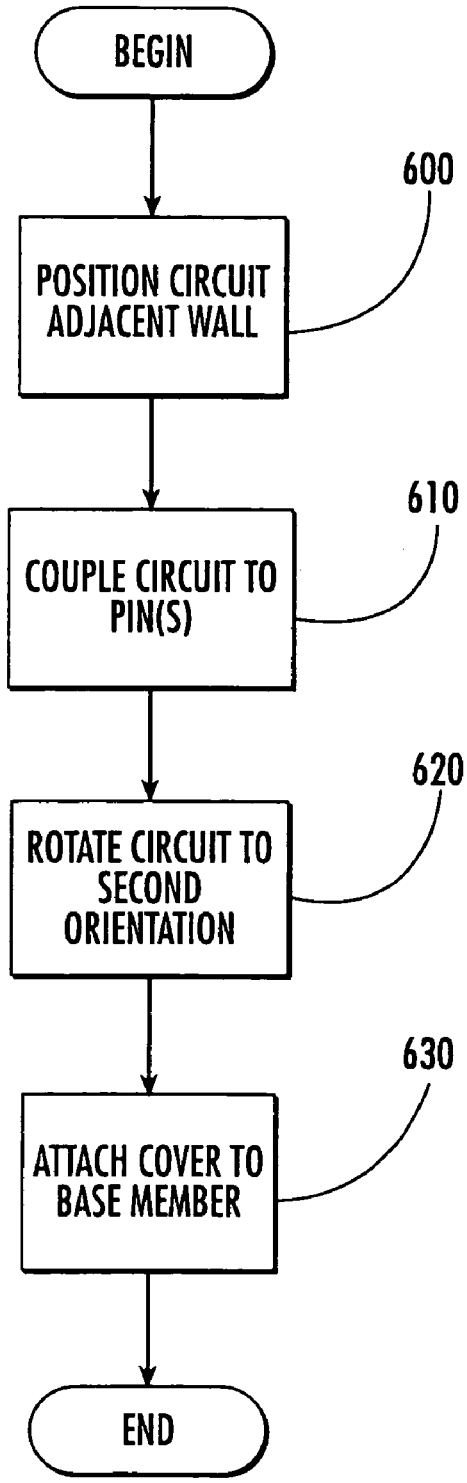
FIG. 6 is a flowchart illustrating operations for attaching an electrical circuit to a pin in a housing according to some embodiments of the present invention.

The flowcharts of FIGS. 5 and 6 illustrate the architecture, functionality, and operation of possible implementations of methods for attaching a pin to a housing according to some embodiments of the present invention. It should be noted that, in some alternative implementations, the acts noted in the blocks may occur out of the order noted in the figures. For example, two blocks shown in succession may, in fact, be executed substantially concurrently, or the blocks may be executed in the reverse order, depending upon the functionality involved. Also, operations additional to those shown and described may be executed in accordance with various embodiments of the present invention.

Figure 7:
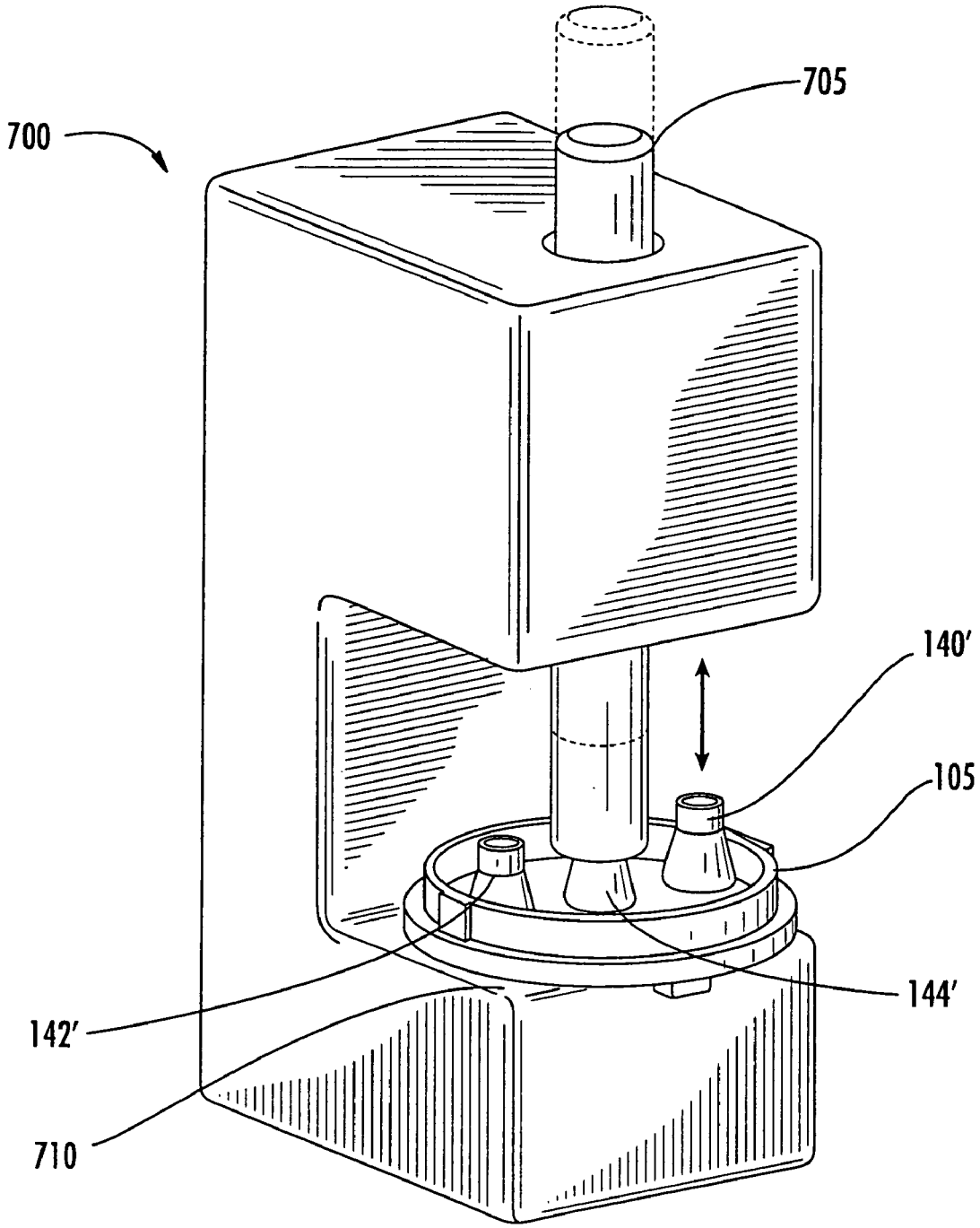
FIG. 7 is a perspective view of a fixture (apparatus) for attaching connector members to a housing wall according to some embodiments of the present invention.
Figure 8:
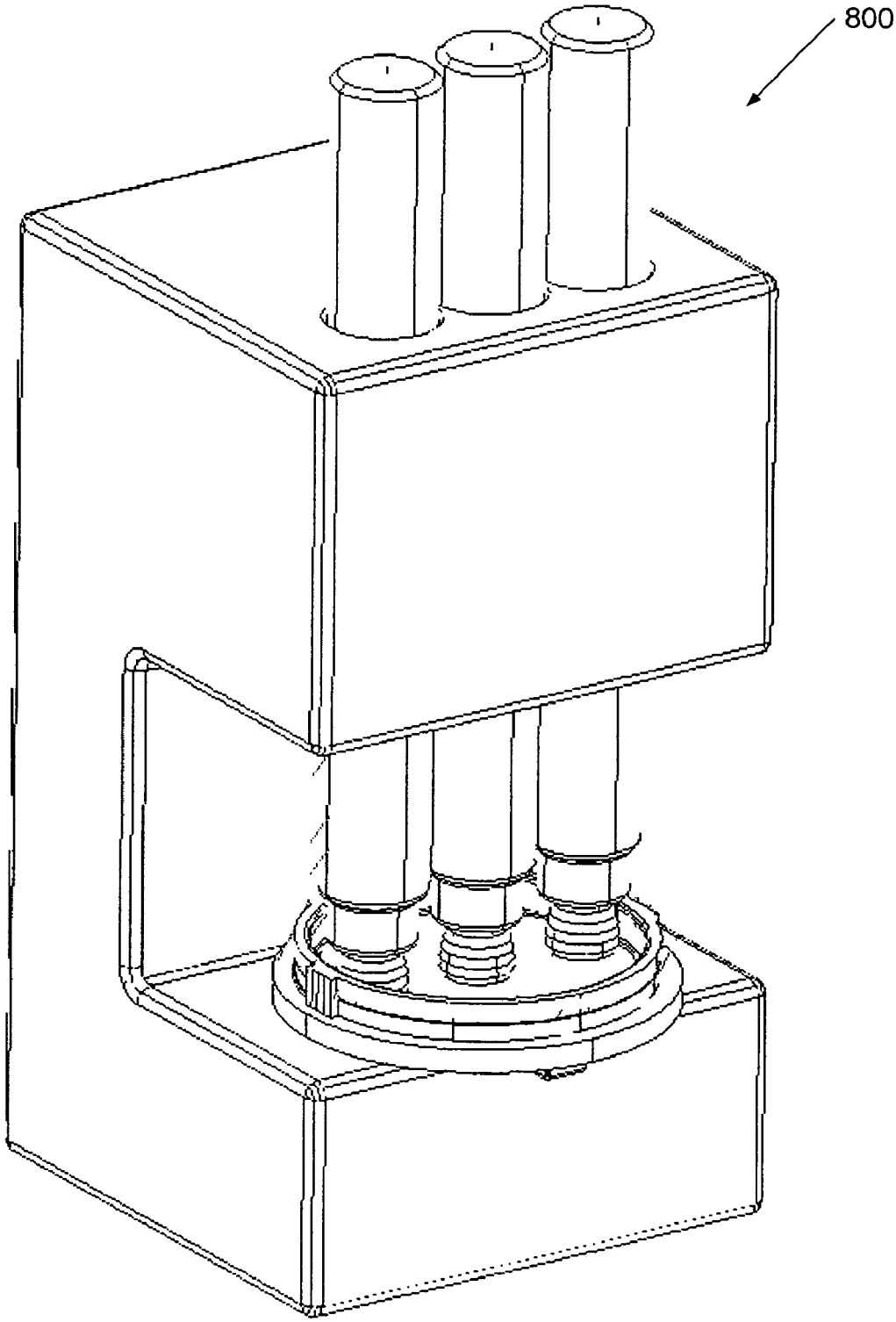
FIG. 8 is a perspective view of a fixture (apparatus) for attaching connector members to a housing wall according to other embodiments of the present invention.

Referring now to FIG. 7, an apparatus (fixture) 700 suitable for use in attaching a pin to a housing according to various embodiments of the present invention will now be described. The embodiments of the apparatus (fixture) 700 shown in FIG. 7 are configured to attach one connector member 140, 142, 144 to the base 105 at a time, however, other embodiments may allow multiple connector members to be attached concurrently. As shown in FIG. 7, the apparatus (fixture) 700 includes a punching pin 705 mounted therein for vertical movement to compress the second end 140', 142', 144' to secure the connector members to a base 105 positioned on the platform 710 of the apparatus 700. For ease of illustration, the pins 160 are not shown in FIG. 7. A three punching pin fixture 800 is illustrated in FIG. 8, the component parts of which operate as described with reference to FIG. 7 and need not be further described herein.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. In the claims, means-plus-function clauses are intended to cover the structures described herein as performing the recited function and not only structural equivalents but also equivalent structures. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

What is claimed is:

1. A method for attaching a pin to a housing, comprising:

forming an opening in a wall of the housing, the opening having an inner diameter corresponding to an outer diameter of a connector member;

positioning the connector member extending through the opening, the connector member having an outer diameter thereof in a region within the wall corresponding to the inner diameter of the opening, a contact member on an end thereof outside the housing, and a longitudinally extending bore therein extending towards and opening into the housing;

positioning the pin with a first end of the pin within the bore and a second end of the pin extending from the bore; and longitudinally compressing the connector member a selected distance towards the wall to secure the pin within the bore and to secure the connector member within the wall.

2. The method of claim 1 further comprising electrically coupling the second end of the pin to an electrical circuit within the housing.

3. The method of claim 2 wherein electrically coupling the second end of the pin comprises soldering the second end of the pin directly to the electrical circuit.

4. The method of claim 2 wherein the wall comprises a base member of the housing and wherein the method further comprises, following electrically coupling the second end of the pin, positioning a cover over the base member to provide the housing enclosing the electrical circuit.

5. The method of claim 4 further comprising coupling the electrical circuit to a circuit external to the housing by electrically coupling the contact member to the circuit external to the housing.

6. The method of claim 5 wherein the contact member comprises an alternating current (AC) power connector and wherein coupling the contact member to the circuit external to the housing comprises inserting the contact member into an AC power receptacle.

7. The method of claim 6 wherein the electrical circuit within the housing comprises a photocontrol sensor circuit.

8. The method of claim 1 wherein longitudinally compressing the connector member comprises forming a bell shaped rivet around the pin from a portion of the connector member including the bore.

9. The method of claim 1 wherein forming an opening in the wall comprises forming three openings and positioning a connector member in each opening and positioning a pin in a bore of each connector member and longitudinally compressing each connector member to secure the pins within the bores and to secure the connector members within the wall.

10. The method of claim 1 wherein the bore ends at a point intermediate an inner and an outer surface of the wall when the connector member is positioned in the housing.

11. The method of claim 10 wherein the wall has a thickness between its inner and outer surfaces of about 1.75 millimeters (mm) and wherein the bore ends at a point of from about 0.2 mm from the inner surface to about 0.5 mm from the inner surface.

12. The method of claim 10 wherein the outer diameter of the connector member is about 3.2 millimeters (mm) and wherein the inner diameter of the opening in the wall is about 3.35 mm and wherein the bore has a diameter of about 2.5 mm and wherein the pin has an outer diameter of about 2.25 mm.

13. The method of claim 1 wherein the housing comprises a first and second housing part and wherein the first housing part includes the wall and wherein the method further comprises:

positioning a flexible electrical circuit adjacent the wall in a first orientation;

electrically coupling the flexible electrical circuit directly to the second end of the pin;

rotating the flexible electrical circuit to a second orientation having a portion thereof extending substantially orthogonally from the wall; and attaching the second housing part to the wall to enclose the flexible electrical circuit therein in the second orientation.

14. The method of claim 13 wherein the flexible circuit comprises a photocontrol sensor circuit and wherein the contact member comprises an alternating current (AC) power connector and wherein coupling the contact member to the circuit external to the housing comprises inserting the contact member into an AC power receptacle.

15. The method of claim 1 wherein longitudinally compressing the connector member comprises longitudinally compressing the connector member without cracking the wall and wherein the selected distance and a depth of the bore are selected to prevent cracking of the wall.

16. An electrical circuit assembly comprising:

a housing having an opening in a wall thereof;

a connector member attached to and extending through the opening in the wall of the housing, the connector member having a contact member on an end thereof outside the housing and a longitudinally extending bore therein extending towards and having an opening into the housing, the wall having substantially no cracks therein in a region proximate the opening; and a pin having a first end positioned within the bore and a second end extending from the opening of the bore, a portion of the connector member around the first end of the pin being collapsed to contact and retain the pin within the bore and to contact an inner surface of the wall to retain the connector member within the wall.

17. The assembly of claim 16 further comprising an electrical circuit within the housing that is electrically coupled to the second end of the pin.

18. The assembly of claim 17 wherein the electrical circuit is soldered directly to the second end of the pin.

19. The assembly of claim 17 wherein the wall comprises a base member and the housing further comprises a cover coupled to the base member and positioned over the electrical circuit.

20. The assembly of claim 17 wherein the contact member comprises an alternating current (AC) power connector.

21. The assembly of claim 20 wherein the assembly comprises a photocontrol device and wherein the electrical circuit comprises a photocontrol sensor circuit.

22. The assembly of claim 17 wherein the collapsed portion of the connector member around the first end of the pin is substantially bell shaped.

23. The assembly of claim 17 wherein the electrical circuit is a flexible electrical circuit having a portion thereof extending longitudinally within the housing substantially orthogonally to a portion thereof coupled to the second end of the pin.

24. The assembly of claim 17 further comprising a second and a third connector member extending through second and third openings in the wall of the housing and having contact members thereon and a second and third pin respectively extending from openings of bores in the second and third connector members, the second and third connector members being collapsed to contact and retain their respective pins within their respective bores and to retain the connector members within the wall, wherein the contact members comprise an alternating current (AC) power connector.

25. The assembly of claim 17 wherein the bore ends at a point intermediate an inner and an outer surface of the wall when the connector member is positioned in the housing.

26. The assembly of claim 25 wherein the wall has a thickness between its inner and outer surfaces of about 1.75 millimeters (mm) and wherein the bore ends at a point of from about 0.2 mm from the inner surface to about 0.5 mm from the inner surface.

27. The assembly of claim 25 wherein the outer diameter of the connector member is about 3.2 millimeters (mm) and wherein the inner diameter of the opening in the wall is about 3.35 mm and wherein the bore has a diameter of about 2.5 mm and wherein the pin has an outer diameter of about 2.25 mm.

28. A connector member for attaching in a wall of a housing, comprising:

a contact member on an end thereof to be positioned outside the housing;

a longitudinally extending bore therein extending towards and having an opening at an end of the connector member opposite the contact member, the bore being configured to receive a pin therein; and wherein a length of the bore from the opening to an opposite end of the bore and a wall thickness of the connector member around the bore are selected to allow collapsing of the connector member into a substantially bell shape around a pin positioned in the bore to retain the pin in the bore and to retain the connector member in the housing and wherein the length of the bore is less than the length of the connector member to provide a solid portion of the connector member extending from the opposite end of the bore to the contact member.

29. The connector member of claim 28 wherein the length of the bore and the wall thickness of the connector member around the bore are selected to allow collapsing of the connector member without cracking of the housing proximate the connector member and wherein the opposite end of the bore is configured to provide receive the pin positioned in the bore.

* * * * *